US007726499B2

(12) United States Patent
Williamson et al.

(10) Patent No.: US 7,726,499 B2
(45) Date of Patent: Jun. 1, 2010

(54) BOTTLE HOLDER

(75) Inventors: Ray Williamson, Toronto (CA); Paul Gerrard, Burlington (CA)

(73) Assignee: Innovative Household Products, Inc., Toronto (CA)

( * ) Notice: Subject to any disclaimer, the term of this patent is extended or adjusted under 35 U.S.C. 154(b) by 207 days.

(21) Appl. No.: 11/447,698

(22) Filed: Jun. 6, 2006

(65) Prior Publication Data

US 2007/0012651 A1 Jan. 18, 2007

(30) Foreign Application Priority Data

Jun. 7, 2005 (CA) ..... 2510299

(51) Int. Cl.
*B65D 23/10* (2006.01)

(52) U.S. Cl. ..... 215/396; 220/737

(58) Field of Classification Search ..... 215/386, 215/396, 397–398; 294/27.1, 30, 32, 33; 220/737, 741, 758, 759, 769; D7/622
See application file for complete search history.

(56) References Cited

U.S. PATENT DOCUMENTS

| | | | | | |
|---|---|---|---|---|---|
| 1,464,789 | A | * | 8/1923 | Ward | 215/226 |
| 1,960,507 | A | * | 5/1934 | Platt | 294/28 |
| 1,977,365 | A | * | 10/1934 | Wolcott | 215/396 |
| 2,088,387 | A | * | 7/1937 | Rice, Jr. et al. | 215/395 |
| 2,116,148 | A | * | 5/1938 | Hawley | 248/145.6 |
| 2,122,628 | A | * | 7/1938 | Tracy | 220/740 |
| D149,933 | S | * | 6/1948 | Bushman | D7/622 |
| 2,810,503 | A | * | 10/1957 | Krueger | 220/742 |
| 2,843,302 | A | * | 7/1958 | Bandy | 220/737 |
| 2,844,346 | A | * | 7/1958 | Six | 248/141 |
| 2,944,700 | A | * | 7/1960 | Stevenson | 220/737 |
| 3,373,897 | A | * | 3/1968 | Haines | 220/737 |
| 4,368,826 | A | | 1/1983 | Thompson | 215/100 |
| 4,379,578 | A | | 4/1983 | Schuler | 294/31.2 |
| 4,597,749 | A | * | 7/1986 | O'Brien et al. | 493/226 |
| 4,746,028 | A | * | 5/1988 | Bagg | 220/739 |
| 4,982,868 | A | * | 1/1991 | Robbins, III | 220/742 |
| 5,013,074 | A | * | 5/1991 | Galle | 294/33 |
| 5,025,940 | A | | 6/1991 | Akly | 215/100 |
| 5,183,169 | A | * | 2/1993 | Grzych | 215/395 |
| D335,608 | S | * | 5/1993 | Arnold | D7/317 |
| D343,094 | S | * | 1/1994 | Varney | D7/622 |
| 5,413,231 | A | * | 5/1995 | Carroll et al. | 215/396 |
| D359,657 | S | * | 6/1995 | Davidson et al. | D7/622 |
| 5,433,339 | A | * | 7/1995 | Sarver | 220/756 |
| 5,580,343 | A | * | 12/1996 | Cafiero | 482/139 |

(Continued)

FOREIGN PATENT DOCUMENTS

EP 0652158 A1 * 5/1995

*Primary Examiner*—Sue A Weaver
(74) *Attorney, Agent, or Firm*—Vidas, Arrett & Steinkraus P.A.

(57) ABSTRACT

A bottle holder with an indented base, which has a body sized and shaped to receive a bottle. At least a portion of the body is radially expandable. A grip is attached to the exterior of the body and a securing base is located within the interior of the body. The securing base is sized and shaped to receive the indented base of a bottle and, when in use, to prevent radial movement of the bottle. When a bottle is inserted into the body, it is received by the indented base and is securely held in the bottle holder by the grip.

19 Claims, 12 Drawing Sheets

U.S. PATENT DOCUMENTS 5,816,631 A * 10/1998 Kochan ..... 294/33
5,921,431 A 7/1999 Pych ..... 220/742
6,003,205 A * 12/1999 Dehaven ..... 16/425
D440,496 S * 4/2001 Adam et al. ..... D7/622
D449,968 S * 11/2001 Reed ..... D7/622
6,729,665 B1 * 5/2004 Posey et al. ..... 294/31.2
7,207,538 B2 * 4/2007 Kent-Fawkes ..... 248/311.2
2001/0040380 A1 11/2001 Forjone ..... 294/31.2
2003/0214140 A1 11/2003 Lynd ..... 294/27.1
2004/0135049 A1 7/2004 Kent-Fawkes ..... 248/311.2
2004/0262375 A1 * 12/2004 Canino ..... 229/117.23

* cited by examiner

BOTTLE HOLDER

CROSS-REFERENCE TO RELATED APPLICATIONS

This application claims priority to Canadian Patent Application No. 2,510,299, filed Jun. 7, 2005, the contents of which is hereby incorporated by reference.

FIELD OF THE INVENTION

This invention relates to the general field of containers, and more particularly to the field of container holders.

BACKGROUND OF THE INVENTION

Modern commercially produced beverages such as soft drinks and juices are generally packaged in standard size, low-cost bottles or cartons for convenient storage and shipment. In the soft drink market in particular, standard, large-size, two-litre plastic bottles have been adopted across the industry. These bottles are constructed from a thin and highly elastic plastic, and have a bottom or base that is indented or ribbed.

Certain features of the standard two litre bottles, however, can be inconvenient for consumers. First, due to their wide diameter and highly flexible or elastic construction, they can be unwieldy and difficult to hold. A related problem is that when the bottles are gripped to perform common tasks such as opening or pouring, the soft elastic wall structure may compress excessively and cause the bottles to unexpectedly spurt or spill some of their liquid contents. This problem is generally more acute when using bottles that are closer to being full, and for users with smaller or weaker hands, such as seniors and children.

Another problematic feature of the standard soft drink bottles is their indented base, which limits their stability when placed on a flat surface. As a result, the bottles are susceptible to being inadvertently knocked or tipped over. This might occur, for example, at large gatherings or where children are present upon a slight jarring of a table surface. Similarly, bottle tipping often occurs in home refrigerators where the bottles stand on thin wire racks. While it is possible to avoid tipping in this case by storing bottles on their side, this is not entirely satisfactory since it results in a loss of usable refrigerator space.

An attempt to address these problems is provided by Pych, U.S. Pat. No. 5,921,431, which teaches a cannister with a handle and a flat base, and a detachable top. The detachable top threads onto the cannister and helps secure the bottle. However, the use of two separate pieces makes the Pych device more costly to manufacture and complicated to use. Also, in practice, some of the liquid soft drink may get on the cannister threads and harden, which is unsanitary and difficult to clean.

Some other devices have been attempted that are constructed from one piece. However, these generally use a type of ring that needs to be snapped into place to support the neck of the bottle when pouring. Such rings may break due to material deformation from repeated use, and may be difficult for some people to use.

SUMMARY OF THE INVENTION

What is desired is a bottle holder which overcomes one or more of the above problems.

The bottle holder should preferably be configured so that it will remain stable and not be prone to tip over when resting on a wire refrigerator shelf or on a flat surface such as a table. Preferably, the bottle holder will make it easier for users to lift and hold the standard two litre soft drink bottles, and also reduce occurrences of spurting and spilling when users open or pour from the bottles. The bottle holder will preferably hold the bottle securely so that there will be minimal risk of the bottle sliding out while being poured.

The bottle holder should preferably be easy to use, so that the bottle can be inserted into the bottle holder without requiring undue manipulation or dexterity. Preferably the bottle holder will be easy to clean, and when in use leave at least a portion of the bottle visible so that the liquid level and beverage brand can be readily observed. The bottle holder will also preferably be inexpensive to manufacture so that it can be made available at a low cost.

Accordingly, there is provided a bottle holder for a bottle having an indented base, said bottle holder comprising:

(a) a body sized and shaped to receive said bottle, at least a portion of said body being radially expandable;

(b) a gripping means attached to an exterior of said body; and (c) a securing base attached to an interior of said body, said securing base being sized and shaped to receive said indented base of said bottle and, when in use, to prevent radial movement of said bottle;

wherein, upon inserting said bottle into said body and receiving said indented base by said securing base, said bottle is securely held in said bottle holder and is operable by a user holding said gripping means.

BRIEF DESCRIPTION OF THE DRAWINGS

Reference will now be made, by way of example only, to preferred embodiments of the invention as illustrated in the attached figures.

DETAILED DESCRIPTION OF THE PREFERRED EMBODIMENTS

Figure 1:
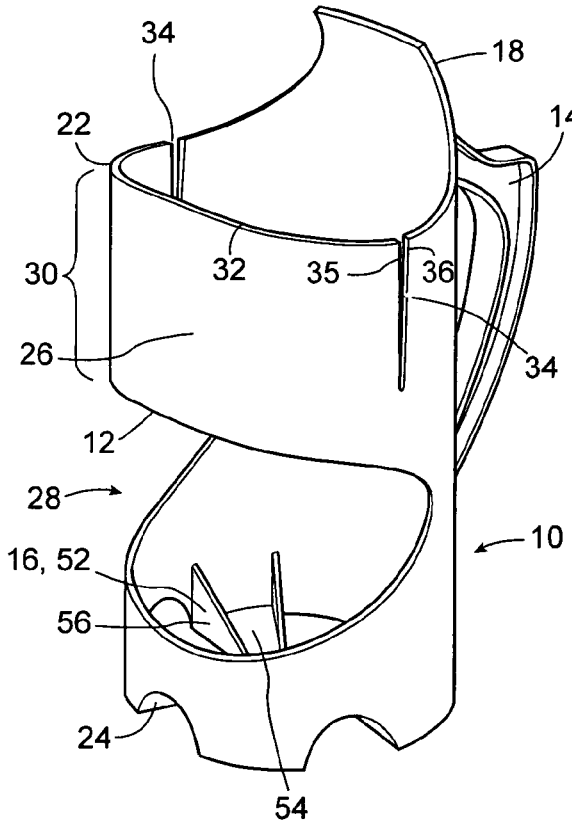
FIG. 1 is a perspective view of the bottle holder of the present invention.
Figure 2:
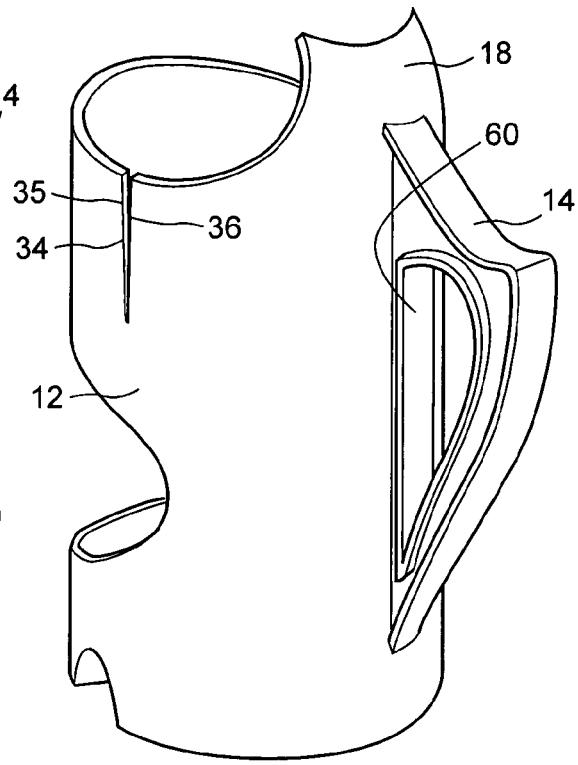
FIG. 2 is another perspective view of the bottle holder of FIG. 1.
Figure 3:
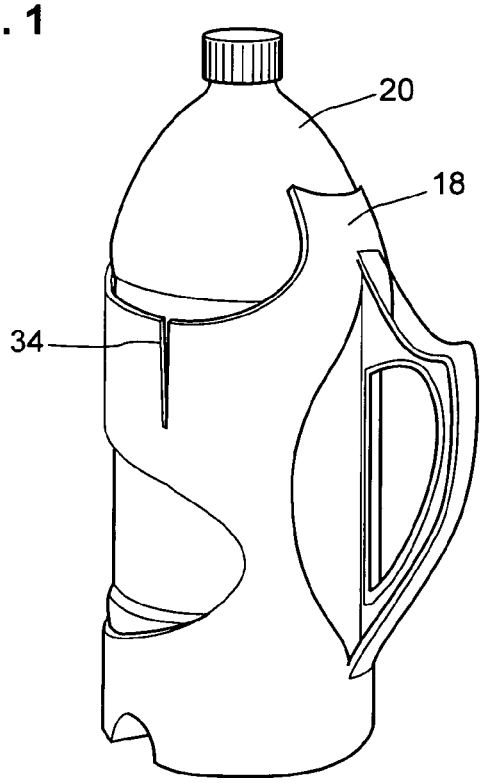
FIG. 3 is a perspective view of the bottle holder of FIG. 1, with a bottle inserted in the bottle holder.
Figure 4:
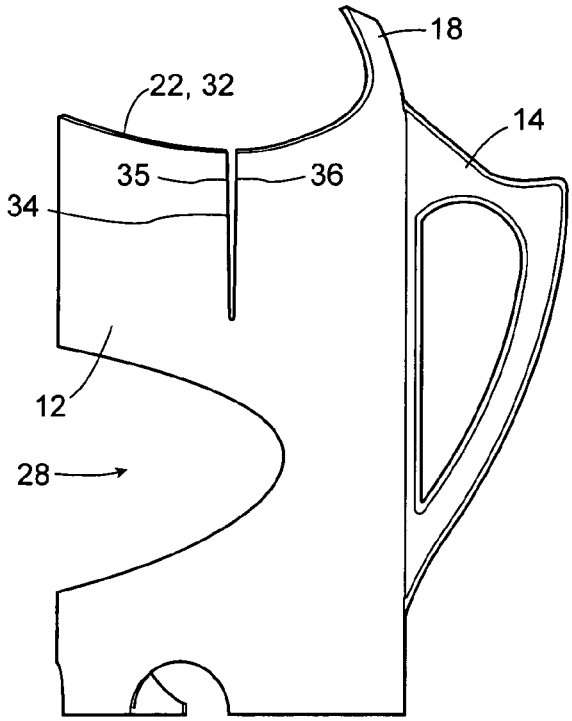
FIG. 4 is a side view of the bottle holder of FIG. 1.
Figure 5:
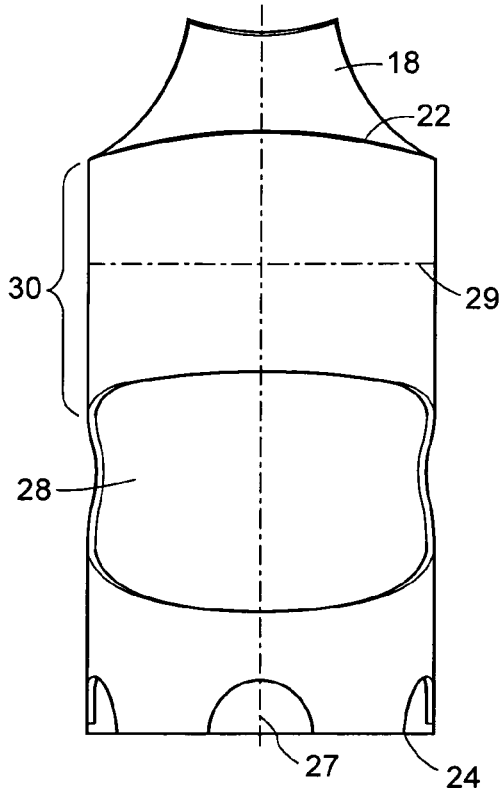
FIG. 5 is a front view of the bottle holder of FIG. 1.
Figure 6:
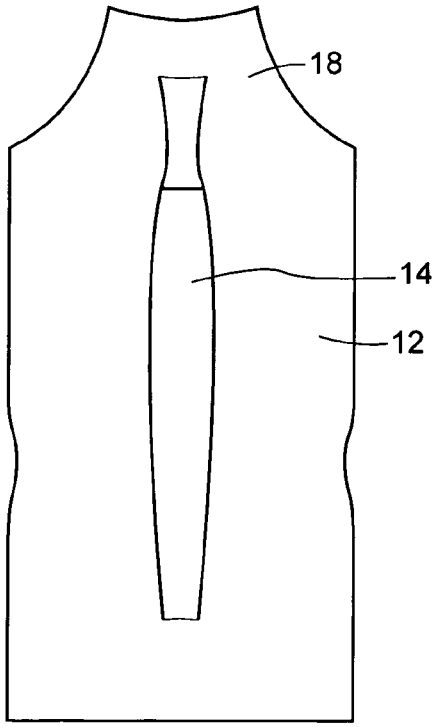
FIG. 6 is a rear view of the bottle holder of FIG. 1.
Figure 7:
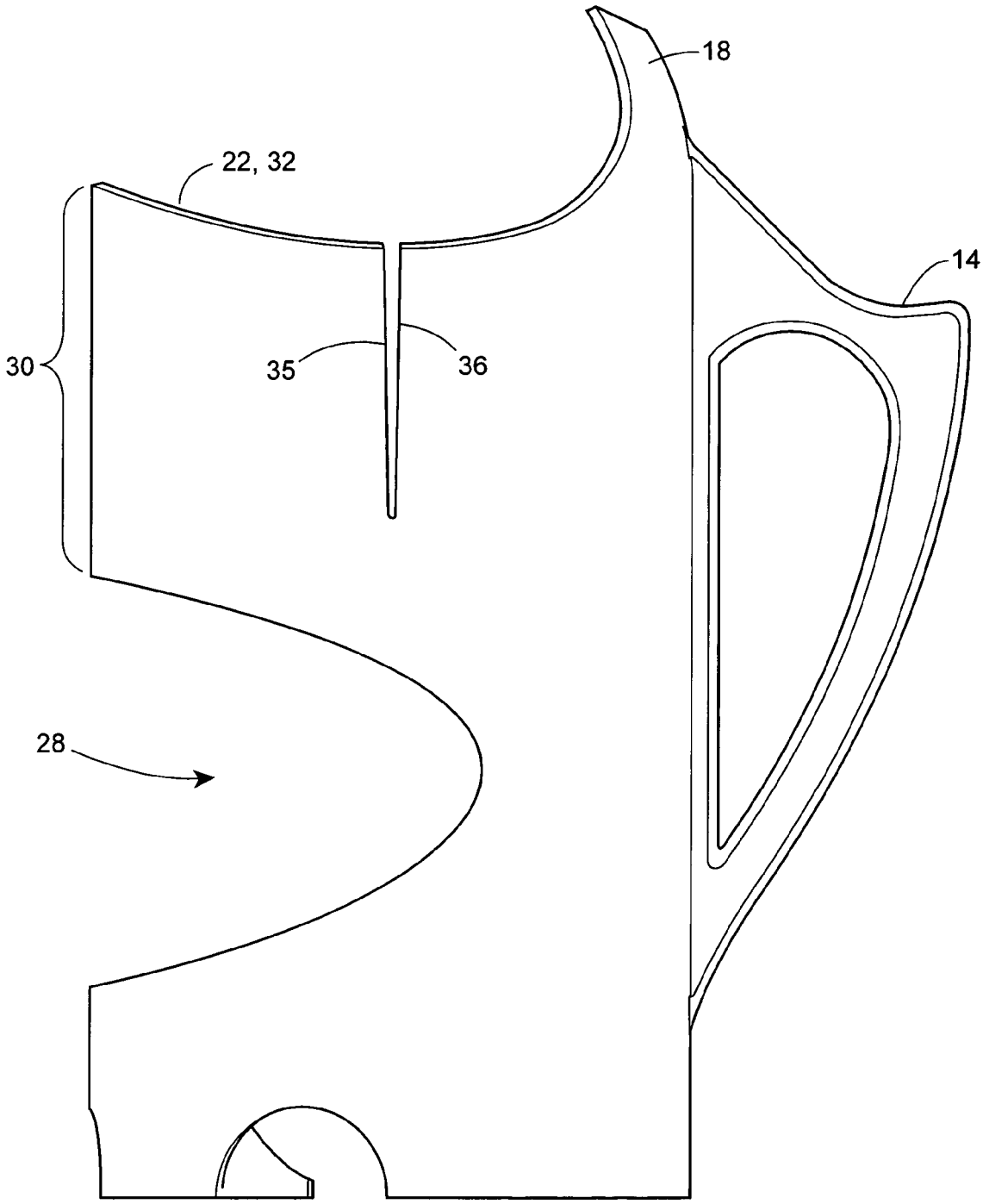
FIG. 7 is another side view of the bottle holder of FIG. 1.
Figure 8:
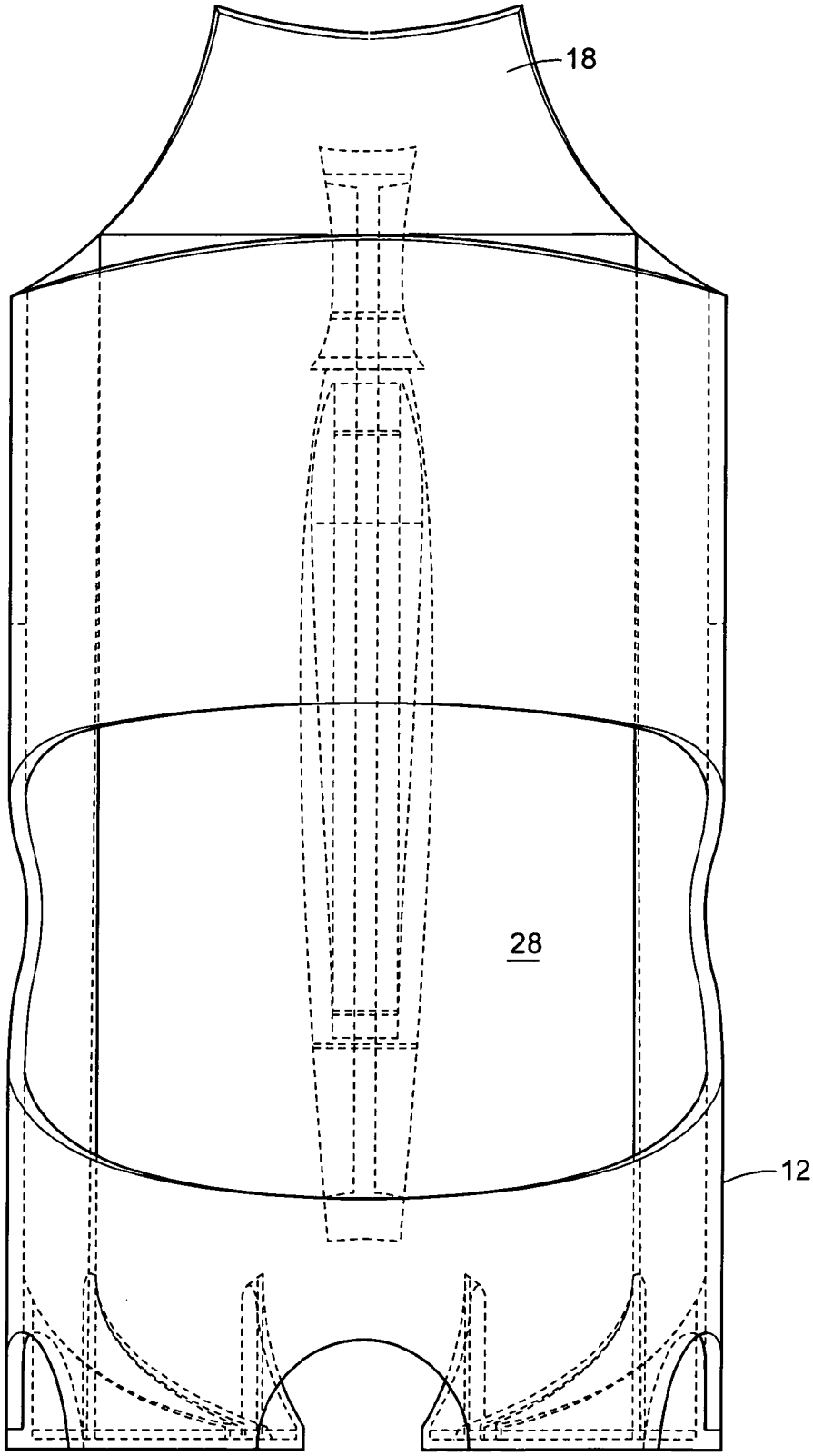
FIG. 8 is another front view of the bottle holder of FIG. 1.

The bottle holder of the present invention is generally designated as 10, and a preferred embodiment is shown in perspective views in FIGS. 1 and 2, side views in FIGS. 4 and 7, front views in FIGS. 5 and 8, and in rear view in FIG. 6. The bottle holder 10 generally comprises a body 12, a gripping means or handle 14, a securing base 16, and may also include a shoulder extension or extended lip 18. The bottle holder 10 is generally configured to hold a bottle 20, as shown in FIG. 3.

The body 12 is sized and shaped to receive the bottle 20, and is preferably constructed as a one-piece, cylindrical shaped unit. The body 12 is preferably open at a top 22 to enable insertion of the bottle, and preferably at least partially open at a bottom 24 to facilitate cleaning and manufacturing of the bottle holder. A portion of the surface of the body 12 may include a branding area 26 on which a vendor or other sponsoring party may provide a brand name or other promotional information. It is also desirable that the body 12 contain an opening or window 28 to reduce the weight of the bottle holder, and to provide an unobstructed view of at least a portion of the installed bottle 20. Accordingly, the window 28 is sized and shaped to be large enough to enable viewing of at least a portion of the bottle 20, but not so large as to compromise the structural integrity and strength of the body 12.

The bottle holder 10 is preferably constructed from plastic, as that material is lightweight, inexpensive, durable, and sufficiently strong to hold the two litre bottle 20 even when full. Plastic can also be easily produced in a variety of colours, and can be imprinted with a desired commercial message anywhere on its surface, such as on the branding area 26. In the preferred embodiment of the invention shown in FIGS. 1-8, a plastic material having a thickness of approximately 0.14 to 0.15 inches produced adequate results. It can be appreciated that other types and thicknesses of plastic, as well as other materials besides plastic may also be used to construct the bottle holder 10, as long as the material used possesses some or all of the features of light weight, durability, strength, and low cost.

A key feature of the body 12 is that it has at least a portion that is radially expandable. As shown in FIG. 5, the bottle holder 10 has a central axis 27 which extends between the top 22 to the bottom 24. There is also shown a radial or diameter 29 which is perpendicular or orthogonal to the axis 27. More particularly, at least a portion of the generally cylindrical body 12 will be configured to radially expand along or in the direction of the diameter 29 to a larger diameter. This portion will preferably be biased to retract back to its original diameter or radial size, and continue to exert a tension or force resisting further expansion. In this way, the radial expansion feature enables the body 12 to expand to accommodate the bottle 20 when the bottle is inserted through the top 22 of the bottle holder, and subsequently retract to grip the bottle after insertion.

In the preferred embodiment shown in FIGS. 1-8, the radially expandable portion of the body 12 comprises an elastic cylindrical element 30 that encircles a corresponding portion of the bottle 20 and has a resting and a stretched position. The cylindrical element 30 is sized and shaped to form a press fit with a portion of the bottle 20 when it is in the resting position or retracting towards the resting position. The cylindrical element 30 has at least one edge 32, and an incision, break, or opening 34 intersecting the edge 32. Preferably there will be two incisions 34 on opposing sides of cylindrical element 30.

It can be appreciated that when the body 12 is constructed from a one-piece plastic in which the cylindrical element 30 is cut to define an incision intersecting an edge, or two or more incisions intersecting an edge, that the cylindrical element 30 will radially expand when a point on one side of the incision 34 is pulled, pried, or forced apart from a point on an opposing side of the incision 34. As this occurs, the incision or incisions 34 will widen, creating greater space between opposing edges 35 and 36 of the incision 34. Further, upon release of the radial force expanding the element 30, the element 30 will revert back to its original diameter due to the natural inclination or force of the elastic construction material to close the gap or space between opposing edges 35 and 36 of the incision 34.

Figure 9:
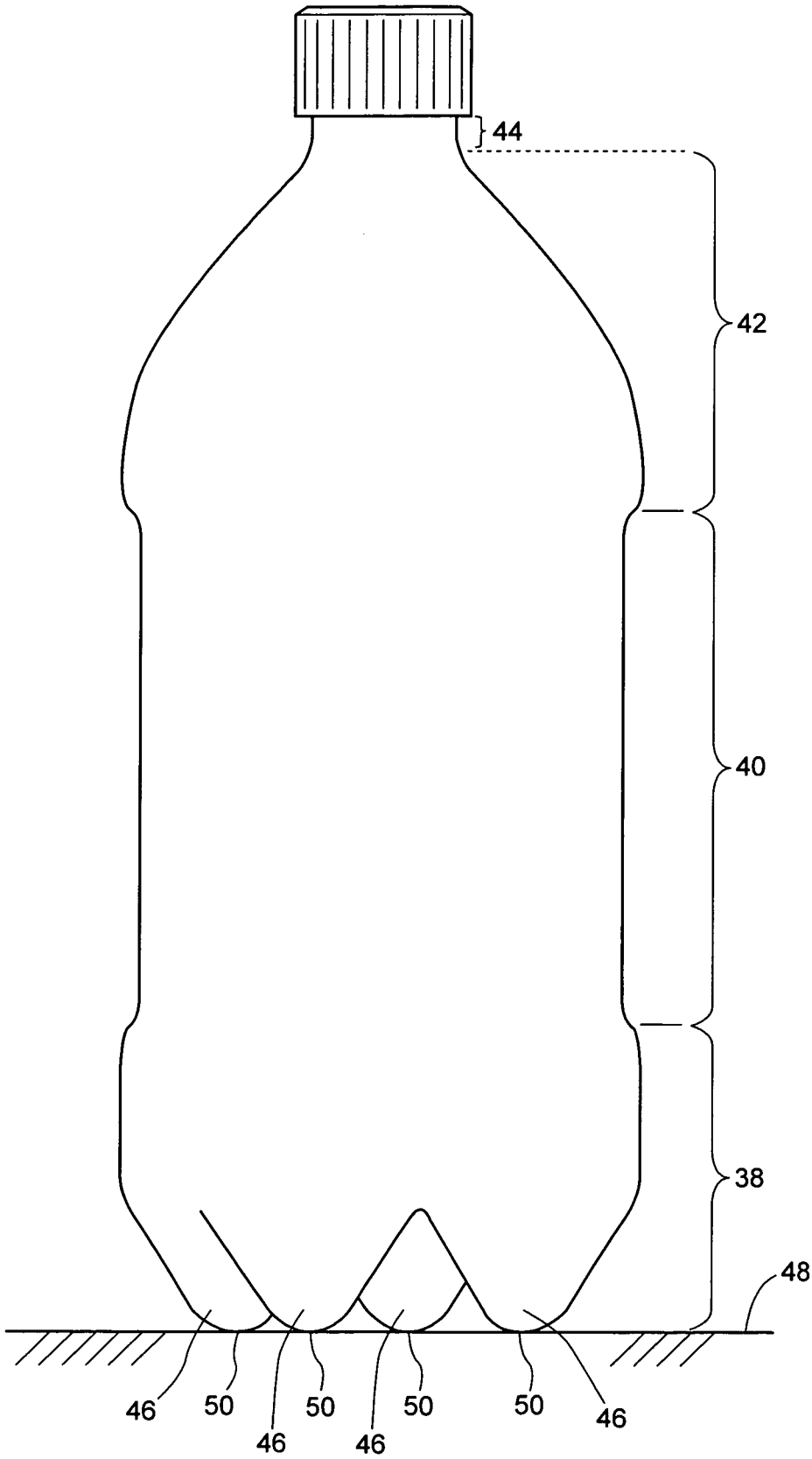
FIG. 9 is a front view of a standard two litre soft drink bottle.

The bottle holder 10 of the present invention is particularly configured to hold bottles having an indented, or non-flat base. This includes, for example, bottles of the type commonly used for beverages such as soft drinks, as shown in FIG. 9. As indicated, the bottle 20 includes a base 38 that is wide at its top and indented or non-flat at its bottom, a middle section 40 that is narrower than the wide portion of the base 38, a shoulder 42, and a neck 44. It can be seen that the shoulder 42 tapers from a wide point at the intersection with middle section 40, to the narrow neck 44.

The cylindrical element 30 is sized and shaped so that when it is radially expanded to the stretched position, it will be sufficiently wide to permit passage of the wide base 38 of the bottle 20. Similarly, element 30 is sized and shaped so that when it is retracting towards the resting position or in the resting position, it will form a close press fit with the middle section 40 of the bottle 20. The shoulder 42 of the bottle 20 will generally be above edge 32 of the bottle holder 10. It can be appreciated that the number, length, and gap width of incisions 34 in the cylindrical element 30 may vary as long as they are appropriate to allow element 30 to meet these functional criteria. Preferably, there are two incisions 34 on either side of the cylindrical element 30, as shown in FIGS. 1-8. Preferably the incisions 34 are between one-half and three-quarters of the height of the element 30, and most preferably approximately two-thirds the length. The gap width between opposing edges 35 and 36 is preferably a maximum, at top 22, of about one-eighth to one-sixteenth inches. It can be appreciated that these figures will also vary in accordance with the hardness and elasticity of the plastic or other material being used for the body 12 of the bottle holder.

It can also be appreciated that the present invention comprehends other embodiments of the elastic cylinder 30 other than a one-piece plastic with an incision 34. For example, if the material used has sufficient inherent elasticity, such as a rigid rubber, an incision 34 may not be required.

The base of the bottle shown in FIG. 9 comprises five ribs, projections, tabs, or indents 46. As indicated, each rib 46 has a rounded cross-section, and accordingly makes contact with a flat surface 48 over a relatively small surface area 50. The bottle 20 is accordingly supported overall by five points 50 distributed around a perimeter of the base of the bottle. It can be appreciated that this configuration provides less stability than that which would be provided from having a generally flat base.

The securing base 16 is attached to an interior of the body 12, and is sized and shaped to receive the indented base 38 of the bottle 20. The securing base 16 is further configured to secure or lock the indented base 38 to the bottle holder 10 so that, when the bottle 20 is installed in the bottle holder 10, radial movement of the bottle relative to the bottle holder is minimized or prevented.

In the preferred embodiment of the bottle holder 10 shown in the figures, the securing base 16 is comprised of individual sections 52. Each section 52 has a base support 54 that is generally normal to the cylindrical walls of the body 12, so that the base support 54 rests flat when the bottle holder 10 is placed on the flat surface 48. The base support 54 is triangular in the preferred embodiment, but other shapes can also be used. The base support 54 provides stability or support for the bottle holder so that it can rest securely and better resist tipping when placed on the flat surface 48. Each section 52 further includes rib guides 56 which connect the sides of the base support 54 to the body 12, and form a sloping vertical wall on two sides about the base support 54. The rib guides 56 deflect or guide the ribs 46 of the bottle 20 to either side of the rib guides, and closely contact the ribs 46.

The sections 52 are generally configured so that when the bottle 20 is inserted into the bottle holder 10, each rib or indent 46 will fit snugly between corresponding sections 52. More particularly, the bottom of each rib 46 will preferably fit between the rib guides 56 of adjacent sections 52, and the rib guides 56 will be positioned sufficiently close to the ribs 46 so that little or no lateral or radial movement of the ribs 46 will be possible. In this way, the bottle holder 10 of the present invention secures or locks the bottle 20, and reduces or prevents radial movement (i.e. turning/rotation) of the bottle 20. The sections 52 are further sized and shaped so that if the bottle 20 is inserted such that the ribs 46 are positioned to fall within or inside sections 52, the bottle 20 will be blocked from reaching the bottom of the bottle holder 10 by the rib guides 56. Further, the rib guides 56 are sized and shaped so as to radially re-direct the ribs 46 of the base 38 of the bottle towards the gaps between sections 52.

Figure 11:
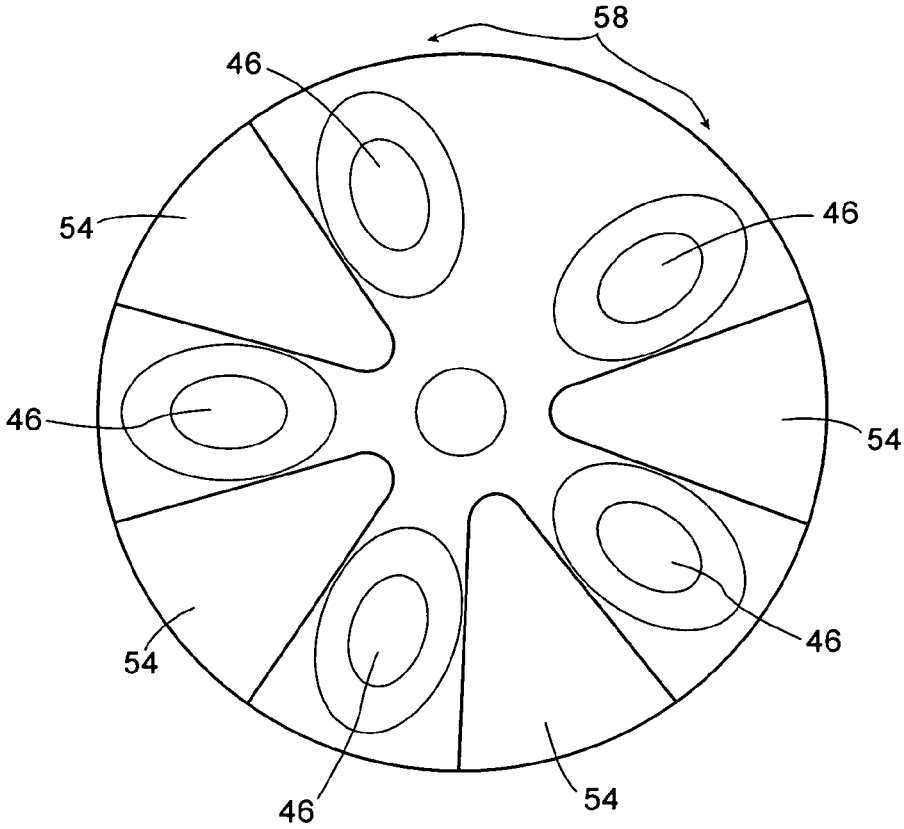
FIG. 11 is a bottom view of the bottle holder of FIG. 1 with a bottle inserted.
Figure 10:
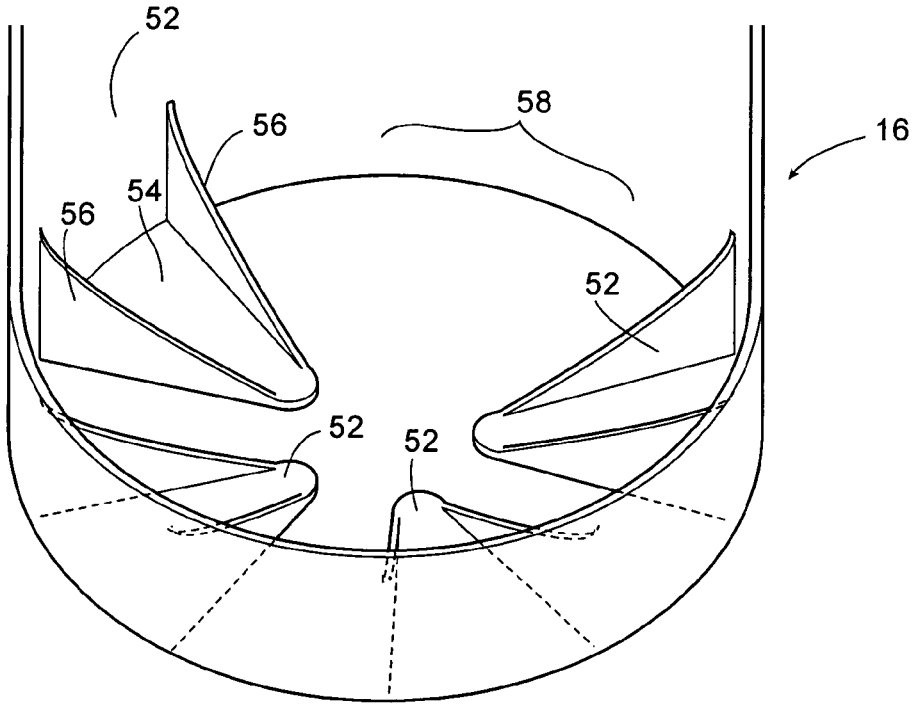
FIG. 10 is a perspective view of the securing base of the bottle holder of FIG. 1.
Figure 12:
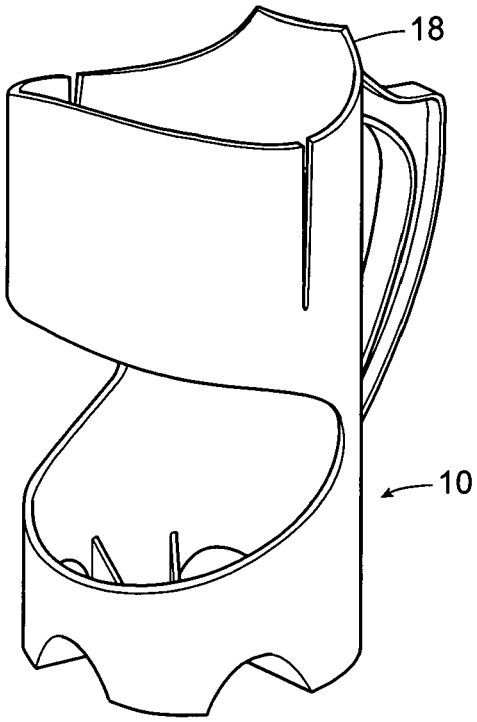
FIG. 12 is a perspective view of a second embodiment of the bottle holder of the present invention.
Figure 13:
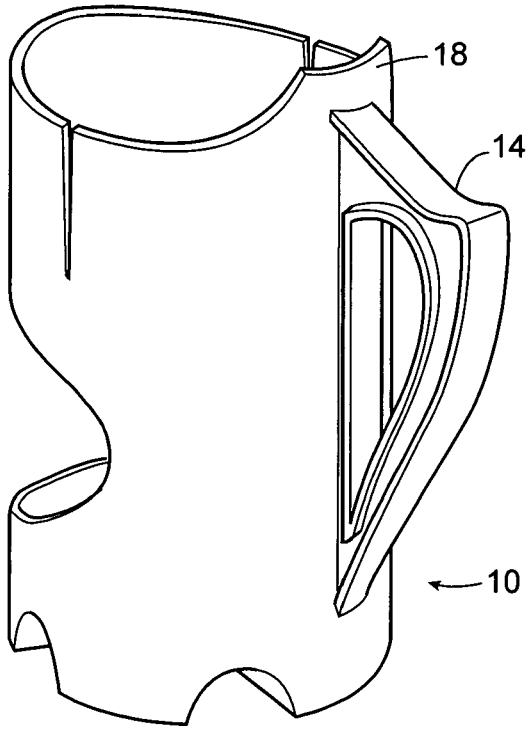
FIG. 13 is another perspective view of the bottle holder of FIG. 12.
Figure 14:
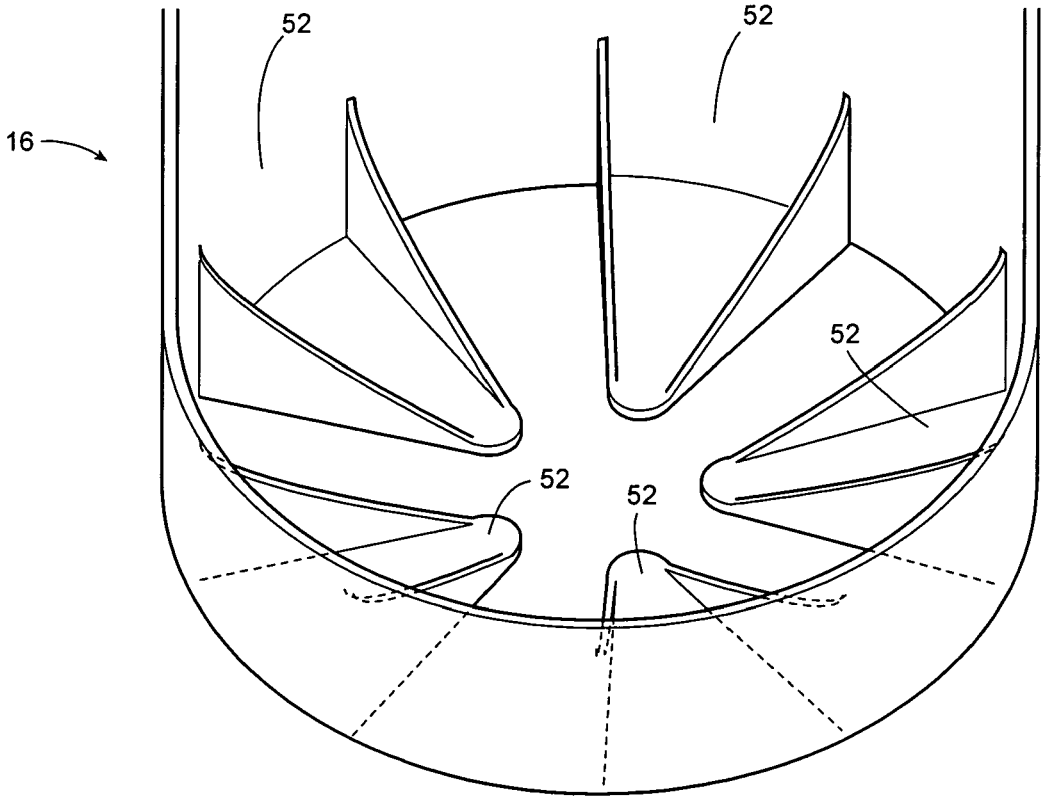
FIG. 14 is a perspective view of the securing base of the bottle holder of FIG. 12.

In the preferred embodiment of the invention shown in FIGS. 1-8, and as shown in greater detail in FIG. 10, the securing base 16 has four sections 52, or one less than the number of ribs 46 in the base 38 of the bottle 20. As indicated in FIG. 10, there is a gap 58 between two of the sections 52 that is wider than the gap between the other adjacent sections 52. FIG. 11 is a view of the bottom of the bottom holder with the bottle inserted. It can be seen that the ribs 46 of the bottle 20 fit between adjacent base supports 54 of each of the four sections 52, and that in the gap 58 there are two ribs 46 without a section 52 between them.

It can be appreciated that each of the base supports 54 provides a much larger surface area in contact with flat surface 48 than that provided by the area 50 of the ribs 46 of the bottle 20. Accordingly, it can be appreciated that the four sections 52 overall provide a larger flat surface area on which to support the bottle 20, when inserted into bottle holder 10, than that otherwise provided to bottle 20 by base 38. It can also be appreciated that the number of sections 52 in the securing base 16 may be varied as appropriate to accommodate bottles 20 that have a different number of ribs 46, and where, for certain embodiments as described below, the number of sections 52 will preferably be one less than the number of ribs 46.

The present invention also comprehends configuring the securing base 16 so that the rib guides 56 are separate and stand apart from the base supports 54. In that case, it may be preferable to construct the rib guides 56 with a greater thickness so that they are more rigid and strong. The present invention also comprehends using a fewer number of rib guides than the eight shown in FIGS. 10 and 11. In particular, the bottle holder 10 may contain only two rib guides and adequately resist rotation of the bottle 20. It is preferred however that there be at least three rib guides, and more preferably more than three such as the eight shown in the preferred embodiment, to provide a stronger resistance to rotation and a firmer hold on the bottle 20. For manufacturing reasons discussed further below, it is also preferred that in some embodiments of the bottle holder 10 that there be at least two adjacent ribs 46 with no intervening rib guide 56, as shown in gap 58 in FIGS. 10 and 11.

Similarly, it can be appreciated that the present invention could have more or fewer base supports 54 than the four shown in FIGS. 10 and 11. The bottle holder could have as few as no base supports 54, since the outer circumference of the bottom 24 of the body 12 provides some additional stability to support the bottle 20. However, it is preferable to have some base support 54, and more preferably a larger area such as that shown in FIGS. 10 and 11, to provide better support for the bottle 20. Further, for some embodiments as discussed below the gap 58 containing two ribs 46 should also be free of any base support 54, in addition to being free of any rib guides 56.

The securing base could also be constructed so that one or more of the ribs 46, except the two within the gap 58, fall or rest directly on the surface of base supports 54 rather than between them as shown in FIG. 11. Yet another configuration comprehended by the present invention is to have sections 52 comprising just one rib guide 56 attached to one side of the base support 54, with the other side of the base support 54 left open and unconnected.

It can be appreciated that the configuration of the securing base 16 in the preferred embodiment of FIGS. 1-8, having multiple sections 52 each of which comprises the support base 54 joined on either side by two rib guides 56, is preferable over the embodiment having separate, stand-alone components because it is generally more rigid and durable, and provides better hold of the bottle 20. Further, the sections 52 in the preferred embodiment are less likely to be bent out of shape or broken off than are the individual components in the stand-alone embodiment.

The shoulder extension or extended lip 18 helps secure the bottle 20 inside the bottle holder 10. In particular, the shoulder extension 18 reduces movement of the bottle 20 in a direction co-axial with axis 27 of the cylindrical element 30, and helps prevent the bottle 20 from slipping out of the bottle holder, particularly when the user is pouring from the bottle. The shoulder extension 30 also assists in resisting turning or rotation of the bottle 20, as might occur for example when the bottle is being opened.

The shoulder extension 18 is sized and shaped to form a press fit with the bottle 20 when the bottle 20 is inserted in the bottle holder 10. As shown in the figures, the shoulder extension 18 is preferably integral with the body 12 at or near its top 22. In this position at the top of the body 12, the shoulder extension 18 contacts and presses against the shoulder 42 of the bottle 20. There is a curvature to the shoulder extension 18, which as shown in FIG. 4 is sized and shaped to substantially match the curvature of the shoulder 42. The shoulder extension 18 is preferably made from the same plastic material as the body 12, but may be made from a different material and attached to the body 12 if desired. The shoulder extension 18 should be flexible and resilient, so that it will flex outwardly when the bottle 20 is being inserted through the top of the bottle holder 22, but then retract and apply an inward pressure when the bottle 20 is fully inserted.

In the preferred embodiment of FIGS. 1-4, the shoulder extension 18 is preferably about 1.9 to 2.0 inches wide at the top, and preferably about 1.8 to 2.0 inches high, most preferably 1.9 inches high, above top 22 where it meets incision 34. The shoulder extension 18 preferably extends between one-quarter to three-quarters of the height of the shoulder 42, and most preferably about half the height of shoulder 42.

The handle 14 is attached to an exterior part of the body 12, and provides a sturdy support element for gripping by the user. The handle 14 is configured to be easily gripped by users of all sizes, including children. In particular, the handle is sized and shaped so that a user's hand can completely wrap around the handle. In this way the user's grip of the handle will be much firmer and sure than the grip that would otherwise be available by grasping the middle section 40 of the bottle directly. The handle 14 accordingly provides more convenient handling, and in particular enables the user to lift and pour the bottle 20 with one hand. The handle 14 is preferably made from the same plastic or other material as the body 12.

In the preferred embodiment of the invention in FIGS. 1-8, the handle 14 attaches to the body 12 at a reinforced spine 60. Spine 60 is illustrated in FIG. 2. The spine 60 is a portion of the body 12, preferably the exterior, which has greater strength and rigidity than the balance of the body 12. This may be achieved by adding additional plastic of other material, or by using a harder and denser material. Preferably the spine 60 will be constructed from the same plastic or other material as the body 12.

As shown in FIGS. 1-4, the handle 14 of the preferred embodiment attaches to the body 12 in two places on the spine 60 (illustrated in FIG. 2), forming a closed loop. The increased strength provided by the spine 60 and by the closed loop connection enables the handle 14 to be more firmly attached to the body 12, which provides enhanced comfort and security for the user.

In the preferred embodiment of the invention, the height of the bottle holder 10 from the top of the shoulder to the bottom of the body 12, for example as most clearly seen in FIG. 7, is approximately 9.533 inches. The width of the device from the front of the body 12 to the back of the handle 14, as most clearly seen in FIG. 7, is approximately 6.8 inches, and the width or diameter of the body 12 as shown in FIG. 8 is approximately 4.6 inches. It can be appreciated that the bottle holder 10 of the present invention may be constructed with other dimensions as appropriate.

Figure 15:
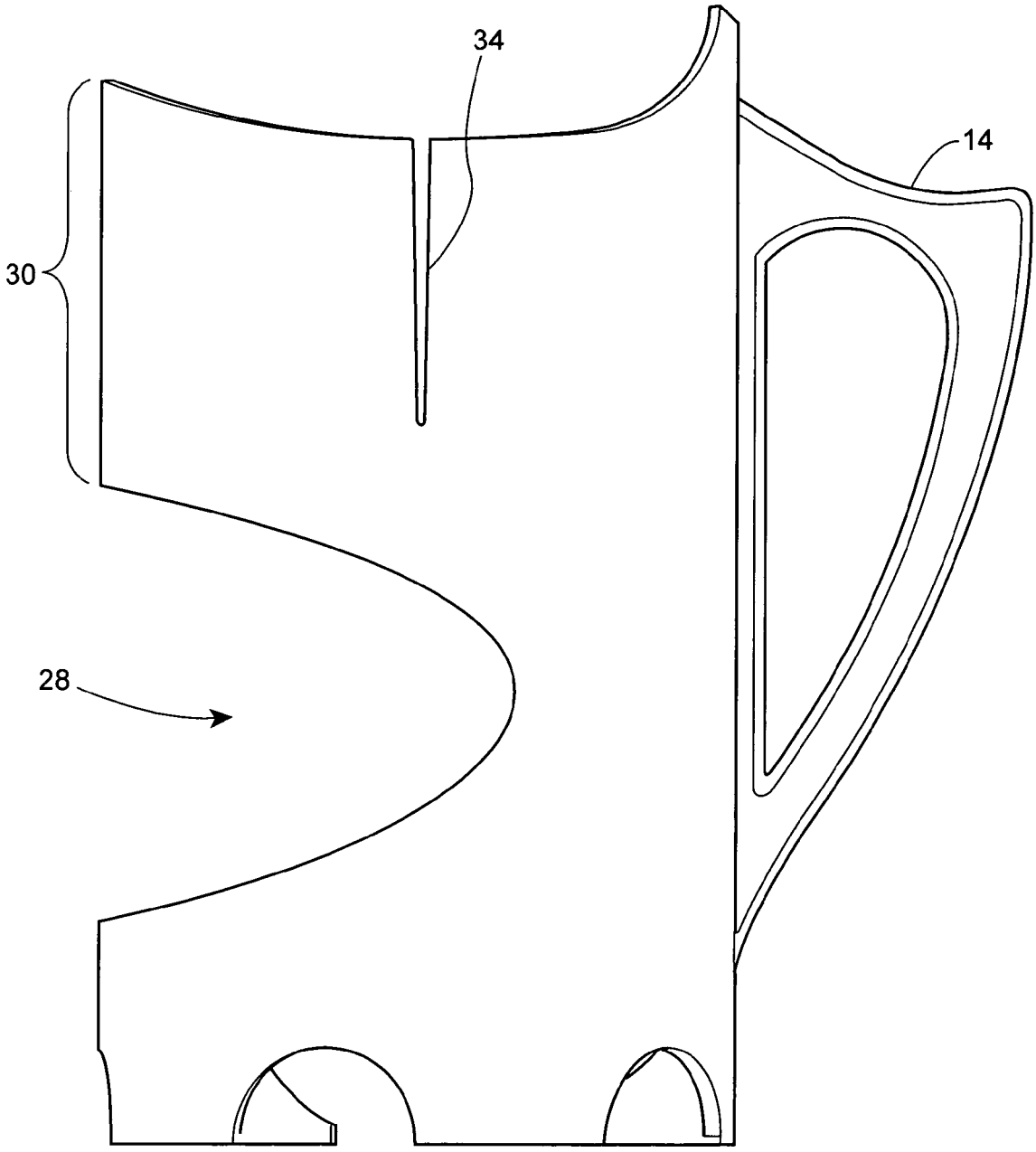
FIG. 15 is a side view of the bottle holder of FIG. 12.
Figure 16:
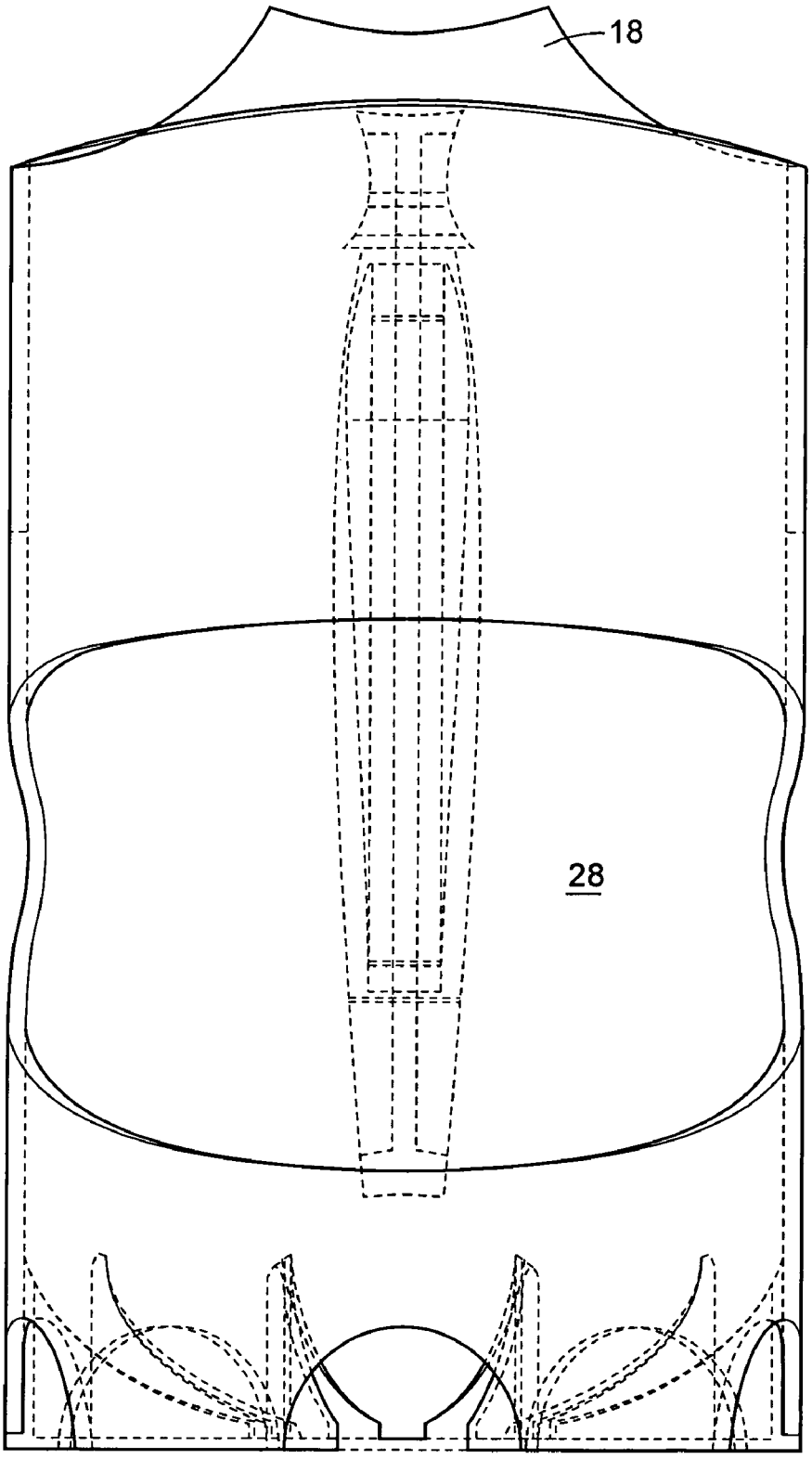
FIG. 16 is a front view of the bottle holder of FIG. 12.
Figure 17:
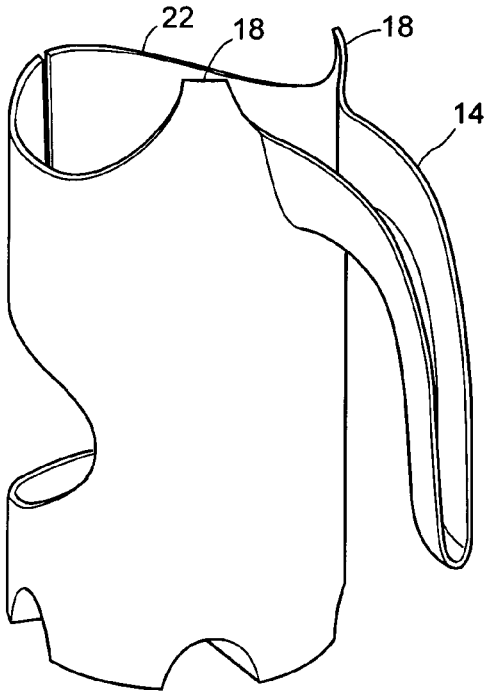
FIG. 17 is a perspective view of a third embodiment of the bottle holder of the present invention.
Figure 18:
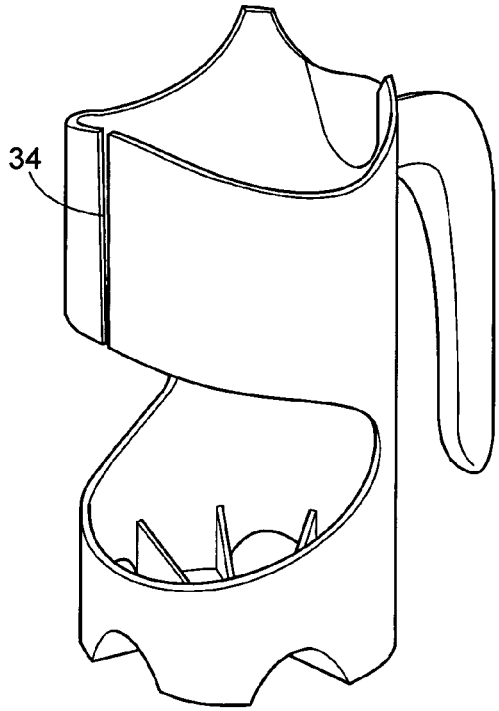
FIG. 18 is another perspective view of the bottle holder of FIG. 17.
Figure 19:
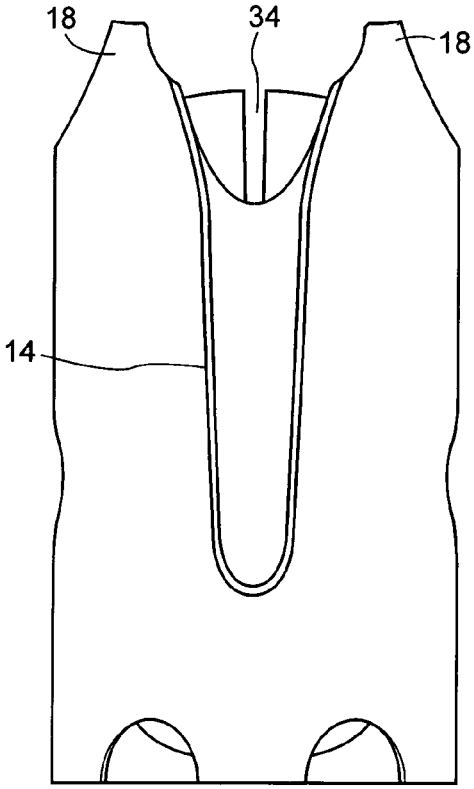
FIG. 19 is a rear view of the bottle holder of FIG. 17.
Figure 20:
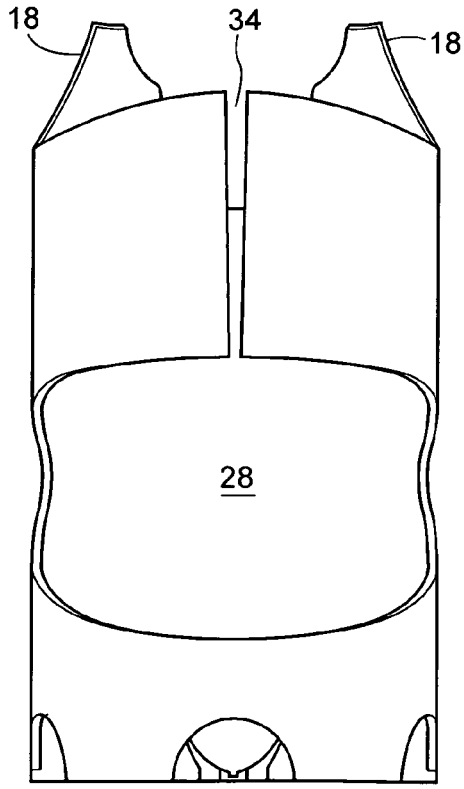
FIG. 20 is a front view of the bottle holder of FIG. 17.
Figure 21:
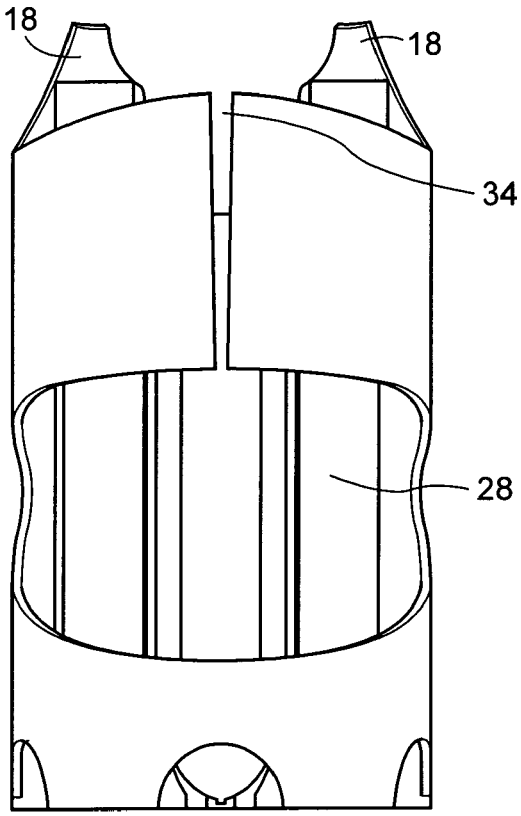
FIG. 21 is another front view of the bottle holder of FIG. 17.
Figure 22:
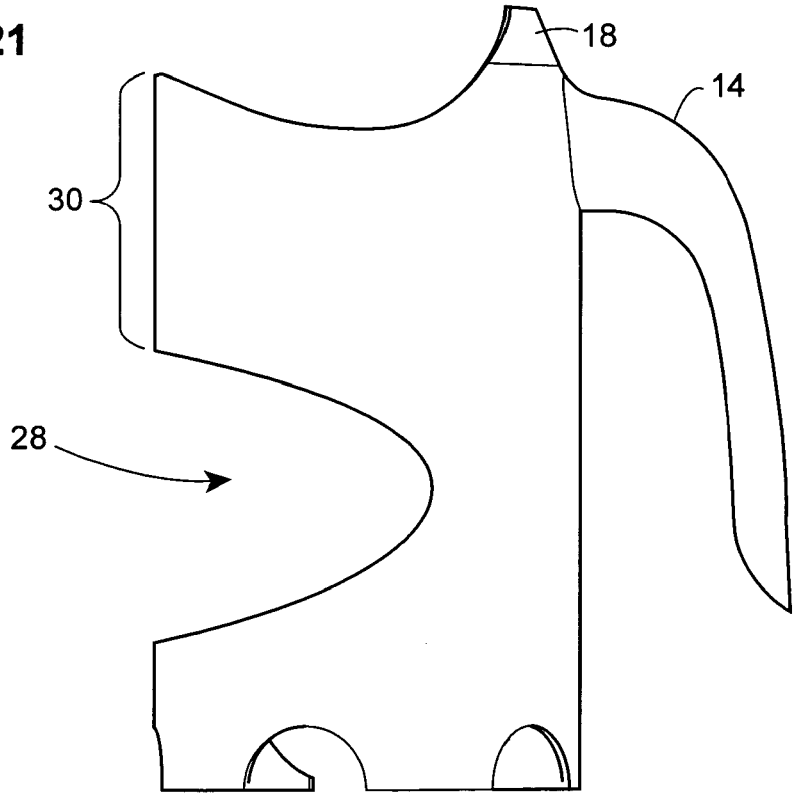
FIG. 22 is another side view of the bottle holder of FIG. 17.

A second embodiment of the invention is shown in FIGS. 12-16. This embodiment differs from the preferred embodiment in that the shoulder 18 is shorter or lower in profile, and the securing base 16 has five sections 52 instead of four. As indicated in FIG. 15, the height of the bottle holder to the top of the shoulder extension 18 is 8.6 inches, or about 0.9 inches less than that of the preferred embodiment, as shown in FIG. 7. The width of the shorter shoulder extension at the top may be the same as the longer one of the preferred embodiment, or approximately 1.9 to 2.0 inches. Preferably, the shorter shoulder extension 18 of the second embodiment is approximately one-quarter of the height of the bottle shoulder 42.

Since the shoulder extension 18 is shorter, the bottle holder of this embodiment will have a less effective grip or hold on the bottle than the bottle holder of the preferred embodiment. There is an advantage however in that the shorter shoulder extension 18 enables manufacture using a less costly mould, and also enables a full five sections 52 to be used in the securing base 16. The full size shoulder extension 18 used in the preferred embodiment may interfere with a movable piece that removes the bottle holder from the mould, and accordingly is preferably manufactured with one less section 52, so that there is a gap 58 that can accommodate two ribs 46.

A third embodiment of the bottle holder 20 is shown in FIGS. 17-22. The handle 14 in this bottle holder is an open loop type and is attached to the body 12 in one place, near the top 22 of the body 12, rather than in two places. In this embodiment, the body 12 is less likely to make use of a spine 60, but if available the handle may be attached to it. There is a single incision 34 at the front of the cylindrical element 30. The shoulder extension 18 is bifurcated into two parts on either side of the handle 14, and may be either the longer one of the preferred embodiment or the shorter one of the second embodiment. Accordingly, the third embodiment of the bottle holder 20 may have either four or five sections 52 in the securing base 16, as appropriate.

Figure 23:
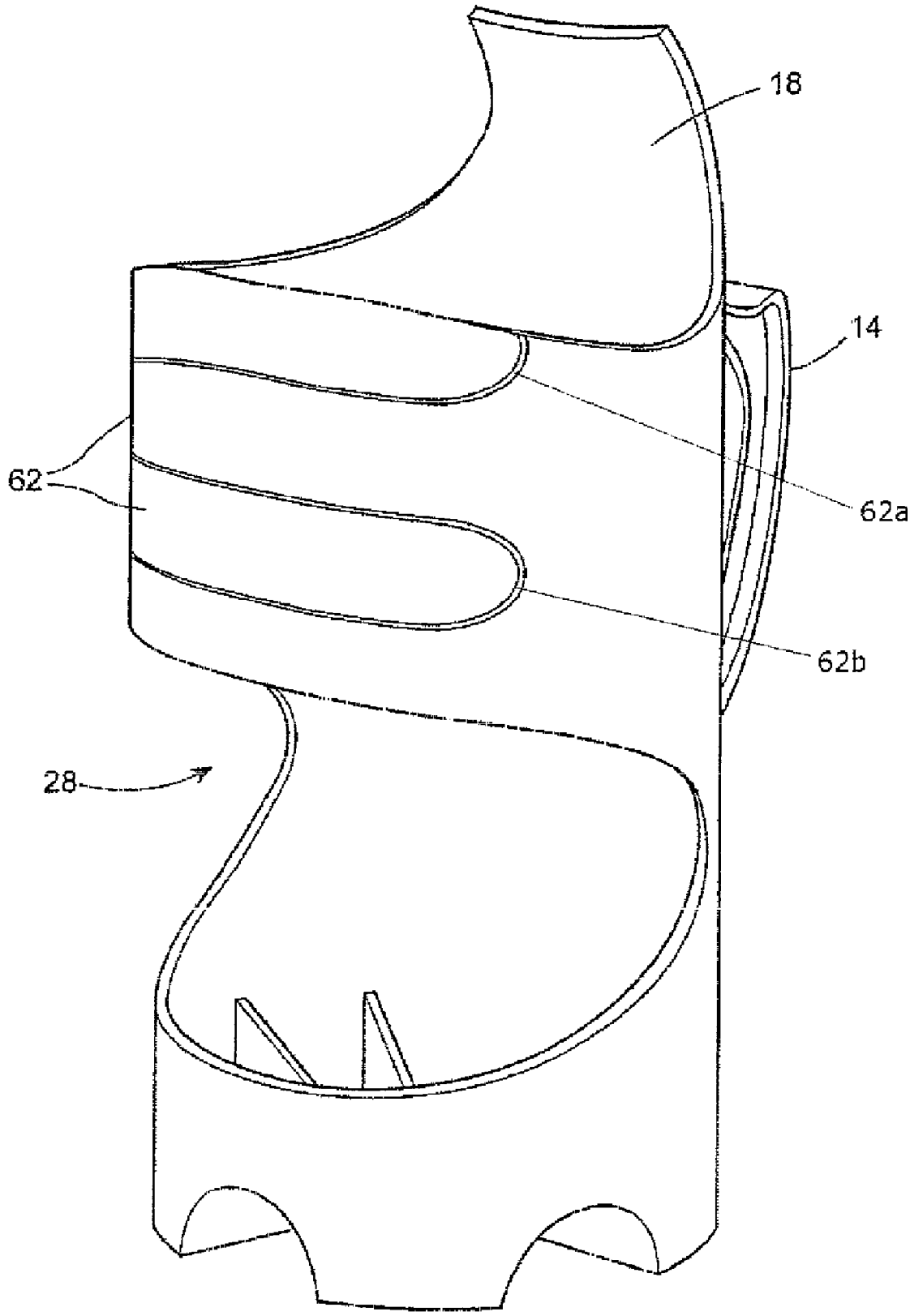
FIG. 23 is a perspective view of a fourth embodiment of the bottle holder of the present invention.

A fourth embodiment of the invention is shown in FIG. 23. This embodiment is similar to the preferred embodiment except that the side incisions 34 are replaced by curved incisions 62*a*, 62*b* which form interleaved fingers 62 in the front of the body 12. A more rigid plastic or other material would be preferred for use with this embodiment, so that the fingers 62 may maintain a close fit on the bottle 20 when the cylindrical element 30 is in the resting position.

The bottle holder 10 may be manufactured by the common plastic injection moulding process, using a single mould. In this way, the bottle holder including the handle 14, securing base 16, and shoulder extension 18, will be produced simultaneously as a one-piece device. It can be appreciated that this process generally enables the bottle holder 10 to be produced at low cost. Further, it can be appreciated that in requiring only a single mould, the present invention is an improvement over other devices which comprise two parts, and that accordingly require two moulds to be manufactured.

The operation of the present invention can now be described. The user will initiate installation of a bottle by lifting and lowering it into the bottle holder through the open top 22. This may be accomplished by holding the bottle holder with one hand on the handle, and holding and lowering the bottle with the other hand. Alternatively, the user could choose to first place the bottle holder on a surface and then hold and lower the bottle using both hands.

Where the bottle holder is the preferred embodiment or otherwise has a full size shoulder extension, the bottle will preferably be inserted by the user at a slight tip or angle, because the curvature of the shoulder extension will prevent a strictly vertical insertion. As the bottle is inserted into the bottle holder, the shoulder extension will generally flex back and the cylindrical element of the body will generally widen or radially expand to accommodate the base 38 of the bottle. In the preferred embodiment, the cylindrical element will expand by the incision gaps on the sides of the body 12 separating or spreading apart. The user will continue to lower the bottle towards the bottom of the bottle holder. If the bottle is oriented so that its ribs 46 are not approximately in-line with the gaps between sections 52 of the bottle holder, the user will observe that the bottle cannot reach the bottom and will rotate the bottle accordingly, guided by the rib guides 56. The bottle will then be lowered so that the ribs 46 are received and secured between the sections 52, or adjacent to rib guides 56. As the bottle reaches this final position, the incision gap will retract so that the cylindrical element closely contacts the bottle. Similarly, the shoulder extension will flex back into position to form a close fit against a portion of the shoulder of the bottle. Accordingly, it can be appreciated that it is relatively easy to install or insert a bottle into the bottle holder of the present invention.

Upon installation, the bottle will be securely held or locked in position by the bottle holder. Movement of the bottle in a vertical or co-axial direction with the body, along axis 27, will be substantially reduced or prevented due to the hold, by contact pressure, of the cylindrical element and the shoulder extension. Similarly, radial movement of the bottle relative to the bottle holder will be limited or prevented due to the ribs 46 in the bottom of the bottle being held in place by the rib guides 56.

As a result, once the bottle is installed the user will be able to lift and manipulate the bottle by holding only the handle 14 of the bottle holder, usually with only one hand, rather than by gripping the bottle directly. Accordingly, it can be appreciated that the present invention reduces the awkwardness or difficulty which frequently accompanies attempts to hold the two litre soft drink bottle directly. There is also a reduced risk of dropping a slippery or wet bottle since the bottle is not being gripped or held directly.

A further aspect of holding the handle is that the bottle will not need to be squeezed by the user. When opening the bottle conventionally, the user will typically grip the bottle with one hand and turn the cap with the other. When pouring, the user will typically grip the bottle with two hands. In each case there is an opportunity for the user to inadvertently squeeze the bottle, which can cause the bottle to spill or spurt liquid, or even for the bottle to be dropped. It can be appreciated that since the present invention removes the need to grip the bottle, the risk of inadvertent squeezing of the bottle, and spilling and spurting of liquid, is substantially reduced.

While using the bottle holder the user can monitor the level of remaining liquid by viewing the bottle through the window 28. When the user is finished activity and places the bottle holder on a flat surface such as a table, or on a wire shelf of a refrigerator, the risk of tipping is substantially reduced due to the increase in flat surface area underneath the bottle provided by the base supports 54 of the bottle holder. When the bottle is empty, it can be easily removed by holding the handle with one hand and pulling out the empty bottle with the other hand through the open top 22. The bottle holder may be reused with other beverage bottles, and can be easily cleaned either in the dishwasher or by hand.

The bottle holder of the present invention also provides marketing and promotional benefits to retailers, beverage producers, and other enterprises. The bottle holders can be imprinted with a brand or message, particularly on the branding area 26. The label of the beverage vendor will continue to be visible to the user through the window 28. Further, sales of soft drinks and other beverages may be stimulated by marketing them in a package with the bottle holder. In such cases the cost of the bottle holder may be included in the selling price, or alternatively it may be absorbed by the vendor as a promotional item. Accordingly, it can be appreciated that the bottle holder of the present invention offers vendors the opportunity of increasing brand awareness, product convenience, and product sales for relatively low or even no cost.

It will be appreciated by those skilled in the art that the foregoing description was in respect of preferred embodiments and that various alterations and modifications are possible within the broad scope of the appended claims without departing from the spirit of the invention. For example, while reference is made to a straight incision in the body of the bottle holder, other forms or patterns may be used. Additionally, other means of enabling radial expansion of the body may be used, such as a strap, belt, or Velcro™ connection. The invention may also be scaled for use with different sizes of bottles 20 other than the two litre size. Various other modifications will be apparent to those skilled in the art but are not described in any further detail herein.

The embodiments of the invention in which an exclusive property or privilege is claimed are defined as follows:

1. A bottle holder for a bottle having an indented base, said bottle holder comprising:

(a) a body sized and shaped to receive said bottle, at least a portion of said body being radially expandable, the body including a reinforced spine and being configured to have greater rigidity than a balance of the body;

(b) a gripping means attached to an exterior of said body at two points so as to form a closed loop, said two points being spaced apart from one another and positioned at said reinforced spine such that the reinforced spine extends from one of said two points to the other; and (c) a securing base attached to an interior of said body, said securing base being sized and shaped to receive said indented base of said bottle and, when in use, to prevent rotational movement of said bottle;

wherein, upon inserting said bottle into said body and receiving said indented base by said securing base, said bottle is securely held in said bottle holder and is operable by a user holding said gripping means.

2. The bottle holder according to claim 1, wherein said radially expandable portion of said body comprises an elastic cylindrical element having a resting and a stretched position, said element being sized and shaped to form a press fit with a portion of said bottle when in said resting position.

3. The bottle holder according to claim 2, wherein said cylindrical element includes at least one edge and an incision intersecting said at least one edge.

4. The bottle holder according to claim 1, wherein said body further includes a shoulder extension sized and shaped to form a press fit with said bottle when said bottle is inserted in said bottle holder.

5. The bottle holder according to claim 1, wherein said body and said gripping means are composed of plastic, and wherein said reinforced spine comprises denser plastic than a remainder of said body.

6. The bottle holder according to claim 1, wherein the body includes a window positioned and sized to permit viewing of a bottle through the window when the bottle is being held in the bottle holder.

7. The bottle holder according to claim 1, wherein the bottle holder comprises a one-piece bottle holder.

8. The bottle holder according to claim 7, wherein the bottle holder is composed of moulded plastic.

9. The bottle holder according to claim 3, wherein the incision has a height that is between 50 percent and 75 percent of a height of the cylindrical element.

10. The bottle holder according to claim 9, wherein the height of the incision is approximately two-thirds of the height of the cylindrical element.

11. The bottle holder according to claim 3, wherein the incision is curved.

12. The bottle holder according to claim 11, wherein the cylindrical element includes at least two incisions shaped and positioned to form interleaved fingers.

13. The bottle holder according to claim 1, wherein the indented base includes ribs, and wherein the securing base comprises a plurality of individual sections to prevent radial movement of said bottle.

14. The bottle holder according to claim 13, wherein the individual sections include at least one rib guide to guide ribs to positions beside said at least one rib guide when the bottle is inserted into the bottle holder.

15. The bottle holder as claimed in claim 14, wherein the rib guides are sized, shaped and positioned to prevent radial movement of the bottle by preventing movement of at least one rib.

16. The bottle holder according to claim 14, wherein the at least one rib guide comprises a sloping vertical wall.

17. The bottle holder as claimed in claim 1, wherein the securing base includes at least one base support to stabilize the bottle holder.

18. The bottle holder as claimed in claim 17, wherein the at least one base support has a triangular shape.

19. The bottle holder according to claim 4, wherein said body further includes two shoulder extensions sized and shaped to form a press fit with said bottle when said bottle is inserted in said bottle holder.

* * * * *